US005929020A

United States Patent [19]

Gross

[11] Patent Number: 5,929,020

[45] Date of Patent: Jul. 27, 1999

[54] PROCESS FOR CHELATING DIVALENT METAL IONS IN ALKALINE DETERGENT FORMULATIONS

[75] Inventor: Stephen F. Gross, Souderton, Pa.

[73] Assignee: Henkel Corporation, Gulph Mills, Pa.

[21] Appl. No.: 08/786,002

[22] Filed: Jan. 21, 1997

[51] Int. Cl.[6] ..... C11D 3/22; C11D 3/36; C11D 11/00

[52] U.S. Cl. ..... 510/436; 510/469; 510/470; 510/511

[58] Field of Search ..... 510/470, 436, 510/469, 511; 252/FOR 239, FOR 238, FOR 160, FOR 204

[56] References Cited

U.S. PATENT DOCUMENTS

| | | | |
|---|---|---|---|
| 3,159,581 | 12/1964 | Diehl | 510/237 |
| 4,233,171 | 11/1980 | McLaughlin et al. | 252/99 |
| 4,392,975 | 7/1983 | Tourdot et al. | 252/99 |
| 4,664,837 | 5/1987 | Gray | 252/99 |
| 4,696,850 | 9/1987 | Malik | 510/420 |
| 5,266,690 | 11/1993 | McCurry, Jr. et al. | 536/18.6 |
| 5,525,256 | 6/1996 | Morris et al. | 510/435 |

OTHER PUBLICATIONS

U.S. S.I.R. H468, May 1988.

*Primary Examiner*—Ardith Hertzog
*Attorney, Agent, or Firm*—Ernest G. Szoke; Wayne C. Jaeschke; Steven J. Trzaska

[57] ABSTRACT

An alkaline cleaning composition containing: (a) from about 0.01 to about 50% by weight of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6; (b) from about 0.05 to about 20% by weight of a silicate component; (c) from about 0.01 to about 5% by weight of a chelating agent consisting of hydroxyethylidene diphosphonic acid; and (d) remainder, water, all weights being based on the weight of the composition.

17 Claims, No Drawings

PROCESS FOR CHELATING DIVALENT METAL IONS IN ALKALINE DETERGENT FORMULATIONS

FIELD OF THE INVENTION:

The present invention generally relates to chelating divalent ions in alkaline detergent compositions. More particularly, the present invention relates to a process for successfully stabilizing divalent ions present in detergent formulations containing alkyl polyglycosides as surfactants.

BACKGROUND OF THE INVENTION:

Sugar surfactants such as, for example, alkyl polyglycosides or fatty acid-N-alkyl glucamides, are distinguished from other surfactants by their excellent detergent properties and high ecotoxicological compatibility. For this reason, these classes of nonionic surfactants are acquiring increasing significance. They are generally used in liquid formulations, for example, dishwashing detergents and hair shampoos.

While conventional sugar surfactants perform satisfactorily in many applications, there is a constant need to both enhance and expand their performance properties. Methods of improving the performance of conventional sugar surfactants by increasing their: foaming and foam stability, tolerance to water hardness and detergency, continue to be sought.

A specific problem associated with sugar surfactants, and particularly alkyl polyglycosides, relates to the undesirable formation of complex ion precipitates during both the production of the alkyl polyglycosides, and during their end-use in wash waters (laundry, dish washing, etc.) due to the presence of hard water metal ions in the process waters.

Alkyl polyglycosides are glucose ethers wherein the anomeric alcohol group is replaced by an alkoxy group. Some of the glucose moieties are oligomerized such that a typical alkyl polyglycoside sample is comprised of a mixture of isomeric monoglycosides, diglycosides, triglycosides, etc., with each higher oligomer present in decreasing amounts. Alkyl polyglycosides have an average degree of oligomerization (DP) of from 1.4 to 1.7 units of glucose. Alkyl polyglycosides are conveniently prepared by reacting an alcohol of the type and chain length which is desired to form the "alkyl" portion of the glycoside of interest with a saccharide reactant (e.g., a monosaccharide such as glucose, xylose, arabinose, galactose, fructose, etc., or a polysaccharide such as starch, hemicellulose, lactose, maltose, melibiose, etc.) or with a glycoside starting material wherein the aglycone portion thereof is different from the alkyl substituent desired for the ultimate alkyl glycoside product of interest. Typically, such reaction is carried out under conditions wherein the alcohol is present in a mole ratio of alcohol/glucose in the range of from 2.0 to 5.0, at an elevated temperature and in the presence of an acid catalyst. The product contains alkyl polyglycoside and excess alcohol which is normally removed by distilling the alcohol from the alkyl polyglycoside product. Because the alcohol distillation operation requires temperatures in excess of 150° C., thermal degradation of the alkyl polyglycoside normally takes place and produces an undesirable color in the product. The alcohol-free alkyl polyglycoside product is then normally subjected to one or more decolorization operations wherein the product is reacted with hydrogen peroxide or a Group I or Group II metal borohydride to remove any color bodies which may have been formed during the prior process steps such as the alcohol removal operation. In the event that hydrogen peroxide is used to bleach the alkyl polyglycoside product, magnesium oxide is typically used as a peroxide stabilizer. Consequently, the bleached alkyl glycoside product contains anywhere from 300 to 500 ppm of magnesium.

When formulating an alkaline cleaning composition, silicates are often employed as builders due to their favorable cost and performance. The incorporation of silicates into cleaning compositions containing alkyl polyglycosides as nonionic sugar surfactants results in the formation of an undesirable magnesium silicate precipitate due to the presence of magnesium ions present in both the alkyl polyglycoside product and process waters. Metal ion precipitates may also be formed during the washing of an article of manufacture wherein hard water ions are present in the wash water. Consequently, the elimination of hard water ion precipitates in wash liquors is also desirable.

SUMMARY OF THE INVENTION

The present invention is directed to an alkaline cleaning composition containing:

(a) from about 0.01 to about 50% by weight of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6;

(b) from about 0.05 to about 20% by weight of a silicate component;

(c) from about 0.01 to about 5% by weight of a chelating agent consisting of hydroxyethylidene diphosphonic acid; and (d) remainder, water, all weights being based on the weight of the composition.

The present invention is also directed to a process for inhibiting the formation of a metal ion precipitate in an alkaline cleaning composition involving the steps of:

(a) providing a chelating solution consisting of:

(i) from about 0.01 to about 5% by weight of a chelating agent consisting of hydroxyethylidene diphosphonic acid; and (ii) from about 25 to about 99.9% by weight of water; and (b) adding to the chelating solution:

(iii) from about 0.01 to about 50% by weight of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; z is a saccharide residue having 5 or 6 carbon atoms; b is a number having a value from 0 to about 12; a is a number having a value from 1 to about 6; and (iv) from about 0.05 to about 20% by weight of a silicate component, all weights being based on the total weight of the composition.

DESCRIPTION OF THE INVENTION:

Other than in the operating examples, or where otherwise indicated, all numbers expressing quantities of ingredients or reaction conditions used herein are to be understood as being modified in all instances by the term "about".

The alkyl polyglycosides suitable for use in the present invention have the general formula I:

$$R_1O(R_2O)_b(Z)_a \quad \text{I}$$

wherein Z is a glucose residue and b is zero. Such alkyl polyglycosides are commercially available, for example, as GLUCOPON®, or PLANTAREN® surfactants from Henkel Corporation, Ambler, Pa. 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.55.
3. GLUCOPON® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.5.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl group contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The alkyl polyglycoside component may preferably be present according to the present invention in amounts of from about 1 to about 5% by weight, based on the weight of the composition. In a particularly preferred embodiment, the alkyl polyglycoside is one of formula I wherein $R_1$ is a monovalent organic radical having from about 8 to about 16 carbon atoms, b is zero, and a is a number having a value of from about 1.50 to about 1.55.

Silicates that are useful in the present invention include, but are not limited to, alkali metal metasilicates, wherein the alkali metal is preferably sodium. Preferred sodium metasilicates include the anhydrous form as well as sodium metasilicates-$5H_2O$. The silicates may preferaby be present according to the present invention in amounts of from about 0.05 to about 20% by weight, based on the weight of the composition.

The chelating agent used in the present invention is hydroxyethylidene diphosphonic acid (HEDP). It was surprisingly discovered that, of the various chelating agents that are available, only hydroxyethylidene diphosphonic acid worked to effectively complex metal ions, specifically magnesium, which in turn prevents the formation of magnesium silicates present in a cleaning composition containing an alkyl polyglycoside employed as at least one of the surfactants comprising the cleaning composition. The hydroxyethylidene diphosphonic acid may preferaby be present according to the present invention in an amount of from about 0.01 to about 5% by weight, based on the weight of the composition.

According to one embodiment of the present invention, there is thus, provided a cleaning composition containing: (a) from about 0.01 to about 50% by weight, and preferably from about 1 to about 5% by weight of an alkyl polyglycoside; (b) from about 0.05 to about 20% by weight, and preferably from about 1 to about 10% by weight of a silicate component, preferably sodium metasilicate-$5H_2O$; from about 0.01 to about 5% by weight, and preferably from about 0.1 to about 1% by weight of hydroxyethylidene diphosphonic acid; and remainder, water, all weights being based on the total weight of the cleaning composition.

The cleaning composition of the present invention may also contain adjuvants such as additional builders, surfactants, viscosity modifiers, emulsifiers, perfumes, dyes, and the like.

According to another embodiment of the present invention, there is provided a process for inhibiting the formation of metal ion precipitates in cleaning compositions containing alkyl polyglycosides and silicates. The process involves forming a solution containing (a) from about 0.01 to about 5% by weight, and preferably from about 0.1 to about 1% by weight of hydroxyethylidene diphosphonic acid and (b) from about 25 to about 99.9% by weight, and preferably from about 80 to about 95% by weight, of water. To this solution there is then added (c) from about 0.01 to about 50% by weight, and preferably from about 1 to about 5% by weight of an alkyl polyglycoside and (d) from about 0.05 to about 20% by weight, and preferably from about 1 to about 10% by weight of a silicate component, preferably sodium metasilicate-$5H_2O$. The order of addition with respect to the chelating agent is critical to the successful complexing of any metal ions, particularly magnesium, present in both the alkyl polglycoside component and process waters. Thus, it is imperative that the alkyl polyglycosides and silicates be added to the chelating solution. Moreover, it is particularly preferred that when forming the chelating solution, the chelating agent be added to the water. The temperature at which the various components are combined can range from about 10 to about 45° C., and is preferably from about 20 to about 30° C. Similarly, the pH at which the composition is formed can range from about 1 to about 3, and is preferably about 2. It should be noted, however, that once the components are combined, the pH of the composition may then be adjusted to a desired level.

The present invention will be better understood from the examples which follow, all of which are intended to be illustrative only and not meant to unduly limit the scope of the invention. Unless otherwise indicated, percentages are on a weight-by-weight basis.

EXAMPLES

Hard surface cleaning compositions were prepared and analyzed to determine stability. The components and amounts used to formulate the samples are found in Table 1 below.

TABLE 1

| Component | Ex. 1 | Ex. 2 | Comp. Ex. 1 | Comp. Ex. 2 | Comp. Ex. 3 |
|---|---|---|---|---|---|
| deionized water | 96.9 | 86.7 | 97.0 | 86.7 | 86.7 |
| HEDP (60%) | 0.1 | 0.3 | — | — | — |
| sodium metasilicate-$5H_2O$ | 1.0 | 3.0 | 1.0 | 3.0 | 3.0 |
| GLUCOPON ® 425 (*) | 2.0 | 10.0 | 2.0 | 10.0 | 10.0 |
| ATMP (*) | — | — | — | 0.3 | — |
| EDTA (*) | — | — | — | — | 0.3 |

(*) GLUCOPON ® 425 = alkyl polyglycoside in which the alkyl group contains 8 to 16 carbon atoms and having an average degree of polymerization of 1.55.
(*) ATMP = aminotris-methylene-phosphonic acid
(*) EDTA = ethylene diamine tetra acetic acid, tetrasodium salt All of the above-identified samples were stored at 47° C. in plastic bottles. All of the comparative example samples developed a precipitate after only one day. Examples 1 and 2, on the other hand, showed no signs of a precipitate forming after 30 days, thus indicating excellent stability.

What is claimed is:

1. An alkaline cleaning composition comprising:

(a) from abut 0.01 to about 50% by weight of a nonionic surfactant consisting of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6;

(b) from about 0.05 to about 20% by weight of a silicate component;

(c) from about 0.01 to about 5% by weight of a chelating agent consisting of hydroxyethylidene diphosphonic acid; and (d) remainder, water, all weights being based on the weight of the composition.

2. The composition of claim 1 wherein in formula I, $R_1$ is a monovalent organic radical having from about 8 to about 16 carbon atoms, b is zero, and a is a number having a value of from about 1.50 to about 1.55.

3. The composition of claim 2 wherein the alkyl polyglycoside is present in the composition in an amount of from about 1 to about 5% by weight, based on the weight of the composition.

4. The composition of claim 1 wherein the silicate component is sodium metasilicate-$5H_2O$.

5. The composition of claim 4 wherein the sodium metasilicate-$5H_2O$ is present in the composition in an amount of from about 1 to about 10% by weight, based on the weight of the composition.

6. The composition of claim 1 wherein the hydroxyethylidene diphosphonic acid is present in the composition in an amount of from about 0.1 to about 1% by weight, based on the weight of the composition.

7. The composition of claim 1 further comprising an adjuvant selected from the group consisting of a builder other than silicates, a surfactant other than an alkyl polyglycoside, a viscosity modifier, a perfume, a dye, and mixtures thereof.

8. An alkaline cleaning composition comprising:

(a) from about 1 to about 5% by weight of a nonionic surfactant consisting of an alkyl polyglycoside of formula I:

$$R_1O(R_2O)_b(Z)_a \qquad \text{I}$$

wherein $R_1$ is a monovalent organic radical having from about 8 to about 16 carbon atoms; $R_2$ is a divalent alkylene radical having from 2 to 4 carbon atoms; Z is a saccharide residue having 5 or 6 carbon atoms; b is 0; a is a number having a value from 1.50 to about 1.55;

(b) from about 1 to about 10% by weight of a sodium metasilicate-$5H_2O$;

(c) from about 0.1 to about 1% by weight of a chelating agent consisting of hydroxyethylidene diphosphonic acid; and (d) remainder, water, all weights being based on the weight of the composition.

9. A process for inhibiting the formation of a metal ion precipitate in an alkaline cleaning composition comprising:

(a) providing a chelating solution consisting of:

(i) from about 0.01 to about 5% by weight of a chelating agent consisting of hydroxyethylidene diphosphonic acid; and (ii) from about 25 to about 99.9% by weight of water, and (b) adding to the chelating solution, at a temperature of from about 10 to about 45° C. and a pH of from about 1 to about 3:

(iii) from about 0.01 to about 50% by weight of an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms;

b is a number having a value from 0 to about 12 a is a number having a value from 1 to about 6; and (iv) from about 0.05 to about 20% by weight of a silicate component, all weights being based on the total weight of the composition.

10. The process of claim 9 wherein in formula I, $R_1$ is a monovalent organic radical having from about 8 to about 16 carbon atoms, b is zero, and a is a number having a value of from about 1.50 to about 1.55.

11. The process of claim 10 wherein the alkyl polyglycoside is present in the composition in an amount of from about 1 to about 5% by weight, based on the weight of the composition.

12. The process of claim 9 wherein the silicate component is sodium metasilicate-$5H_2O$.

13. The process of claim 12 wherein the sodium metasilicate-$5H_2O$ is present in the composition in an amount of from about 1 to about 10% by weight, based on the weight of the composition.

14. The process of claim 9 wherein the hydroxyethylidene diphosphonic acid is present in the composition in an amount of from about 0.1 to about 1% by weight, based on the weight of the composition.

15. The process of claim 9 wherein the chelating solution is formed by adding the chelating agent to the water.

16. The process of claim 9 wherein the alkaline cleaning composition further comprises an adjuvant selected from the group consisting of a builder other than silicates, a surfactant other than an alkyl polyglycoside, a viscosity modifier, a perfume, a dye, and mixtures thereof.

17. A process for inhibiting the formation of a metal ion precipitate in an alkaline cleaning composition according to claim 9 comprising:

(a) providing a chelating solution consisting of:

(i) from about 0.1 to about 1% by weight of a chelating agent consisting of hydroxyethylidene diphosphonic acid; and (ii) from about 80 to about 95% by weight of water; and (b) adding to the chelating solution:

(i) from about 1 to about 5% by weight of an alkyl polyglycoside of formula I:

$$R_1O(R_2O)_b(Z)_a \qquad \text{I}$$

wherein $R_1$ is a monovalent organic radical having from about 8 to about 16 carbon atoms; $R_2$ is a divalent alkylene radical having from 2 to 4 carbon atoms; Z is a saccharide residue having 5 or 6 carbon atoms; b is a number having a value of 0; a is a number having a value from 1.50 to about 1.55; and (ii) from about 1 to about 10% by weight of a sodium metasilicate-$5H_2O$, all weights being based on the total weight of the composition.

* * * * *